US011573007B2

(12) United States Patent
Oda et al.

(10) Patent No.: US 11,573,007 B2
(45) Date of Patent: Feb. 7, 2023

(54) BURNER DEVICE

(71) Applicants: KAWASAKI JUKOGYO KABUSHIKI KAISHA, Kobe (JP); TOKYO METROPOLITAN PUBLIC UNIVERSITY CORPORATION, Tokyo (JP)

(72) Inventors: Takeo Oda, Kobe (JP); Toshiaki Sakurazawa, Kobe (JP); Ryosuke Oshima, Kobe (JP); Saburo Yuasa, Tama (JP); Takashi Sakurai, Hino (JP); Koichi Nozaki, Kobe (JP)

(73) Assignees: KAWASAKI JUKOGYO KABUSHIKI KAISHA, Kobe (JP); TOKYO METROPOLITAN PUBLIC UNIVERSITY CORPORATION, Tokyo (JP)

( * ) Notice: Subject to any disclaimer, the term of this patent is extended or adjusted under 35 U.S.C. 154(b) by 0 days.

(21) Appl. No.: 16/868,650

(22) Filed: May 7, 2020

(65) Prior Publication Data

US 2020/0263871 A1 Aug. 20, 2020

Related U.S. Application Data

(63) Continuation of application No. PCT/JP2018/041366, filed on Nov. 7, 2018.

(30) Foreign Application Priority Data

Nov. 8, 2017 (JP) ..... JP2017-215851

(51) Int. Cl.
*F23D 14/02* (2006.01)
*F23D 14/64* (2006.01)

(52) U.S. Cl.
CPC ..... *F23D 14/02* (2013.01); *F23D 14/64* (2013.01); *F23D 2203/007* (2013.01); *F23D 2205/00* (2013.01); *F23D 2900/14021* (2013.01)

(58) Field of Classification Search
CPC ..... F23D 2900/142021; F23D 14/02; F23D 14/64; F23D 2203/007; F23D 2205/00; F23D 2900/14021
(Continued)

(56) References Cited

U.S. PATENT DOCUMENTS 3,476,494 A * 11/1969 Straight, Jr. ..... F23C 3/006 239/406
5,490,378 A 2/1996 Berger et al.
(Continued)

FOREIGN PATENT DOCUMENTS

JP 2005-226847 A 8/2005
JP 2005-265380 A 9/2005
(Continued)

OTHER PUBLICATIONS

Phillips, Timothy Duane, "An experimental investigation of a miniature hybrid swirl/jet injector" (2007). ETD Collection for University of Texas, El Paso. AAI1445693. https://scholarworks.utep.edu/dissertations/AAI1445693) (Year: 2007).*

*Primary Examiner* — Vivek K Shirsat
(74) *Attorney, Agent, or Firm* — Sughrue Mion, PLLC

(57) ABSTRACT

A burner device for supplying a mixture of a fuel gas and a combustion-supporting gas into a combustion region includes: a mixing path configured to inject the mixture from a downstream end portion of the mixing path into the combustion region; a fuel gas injection nozzle configured to inject the fuel gas into the mixing path toward the combustion region; and a combustion-supporting gas supply swirler configured to inject the combustion-supporting gas such that
(Continued)

at least a part of the combustion-supporting gas collides directly with the fuel gas injected from the fuel gas injection nozzle, in a direction of a tangent line that is tangent to a fuel injection hole of the fuel gas injection nozzle on a cross-section.

4 Claims, 5 Drawing Sheets

(58) Field of Classification Search
USPC ..... 431/352, 182
See application file for complete search history.

(56) References Cited

U.S. PATENT DOCUMENTS

| | | | | |
|---|---|---|---|---|
| 8,455,056 | B1 * | 6/2013 | Browning | C23C 4/129 427/449 |
| 2007/0272201 | A1 | 11/2007 | Amano et al. | |
| 2012/0258409 | A1 | 10/2012 | Mansour et al. | |
| 2012/0291446 | A1 | 11/2012 | Hirata et al. | |

FOREIGN PATENT DOCUMENTS

| | | | |
|---|---|---|---|
| JP | 2006-10193 | A | 1/2006 |
| JP | 2009-287888 | A | 12/2009 |
| JP | 2010-060281 | A | 3/2010 |
| JP | 2016-035358 | A | 3/2016 |

* cited by examiner

BURNER DEVICE

CROSS REFERENCE TO THE RELATED APPLICATION

This application is a continuation application, under 35 U.S.C. § 111(a), of international application No. PCT/JP2018/041366, filed Nov. 7, 2018, which claims priority to Japanese patent application No. 2017-215851, filed Nov. 8, 2017, the entire disclosures of all of which are herein incorporated by reference as a part of this application.

BACKGROUND OF THE INVENTION

Field of the Invention

The present invention relates to a burner device for mixing and burning, for example, a fuel gas such as hydrogen gas and another kind of gas.

Description of Related Art

In recent years, a burner device that utilizes hydrogen as fuel has been suggested for realizing a so-called low-carbon society in order to reduce emissions of carbon dioxide that causes environmental issues such as global warming (for example, see Patent Document 1).

RELATED DOCUMENT

Patent Document

[Patent Document 1] U.S. Patent Application Publication No. 2012/0258409

SUMMARY OF THE INVENTION

However, when a fuel having a high combustion speed is burned, NOx is likely to be generated. When a fuel having a high combustion speed is burned, backfire phenomenon in which flame generated in a combustion chamber is returned to the burner side is likely to occur. Such a fuel is, for example, hydrogen or a gas that contains hydrogen at a high concentration.

In order to overcome these problems, use of a so-called lifted flame is considered. The lifted flame refers to a flame in which a base portion of the flame is formed at a position that is distant from a fuel injection portion in the downstream direction. It is known that a diffusion flame state shifts to the lifted flame state by increasing a flow rate of the fuel. The lifted flame allows reduction of NOx by mixing fuel and air in a space from the fuel injection portion to the base portion of the flame, and lifting of the flame inhibits generation of the backfire phenomenon. A burner having a conventional structure has difficulty in stably forming and maintaining the lifted flame, and is difficult to use for an actual device such as a gas turbine and a boiler in which an operation condition is not always constant.

In order to overcome the aforementioned problem, an object of the present invention is to provide a burner device that can stably form a lifted flame.

In order to attain the aforementioned object, a burner device of the present invention is directed to a burner device for supplying a mixture of a fuel gas and a combustion-supporting gas into a combustion region, and the burner device includes:

a mixing path configured to inject the mixture from a downstream end portion of the mixing path into the combustion region;

a fuel gas injection nozzle configured to inject the fuel gas into the mixing path toward the combustion region; and a combustion-supporting gas supply swirler configured to inject the combustion-supporting gas from a radially outer side to the mixing path such that at least a part of the combustion-supporting gas collides directly with the fuel gas injected from the fuel gas injection nozzle, in a direction of a tangent line that is tangent to a fuel injection hole of the fuel gas injection nozzle in a cross-sectional view orthogonal to an axis of the burner device.

In this configuration, the combustion-supporting gas is applied directly to the fuel gas injected from the fuel gas injection nozzle, whereby a space, from a portion at which the fuel gas is injected, to the combustion region becomes unstable, and a lifted flame is likely to be formed, and mixture is promoted near the fuel gas injection opening. In addition, swirling flow formed by the combustion-supporting gas supply swirler forms a recirculation region around the burner axis near the outlet of the mixing path to stably maintain the lifted flame.

In the burner device according to one embodiment of the present invention, a width of a combustion-supporting gas flow path of the combustion-supporting gas supply swirler may be gradually reduced from an inlet of the combustion-supporting gas supply swirler toward an outlet thereof. In this configuration, the combustion-supporting gas flow is injected at a high speed from the combustion-supporting gas supply swirler, so that a space from the portion at which the fuel gas is injected, to the combustion region, is more effectively made unstable. Thus, the lifted flame is more likely to be formed.

In the burner device according to one embodiment of the present invention, a diameter of a mixture injection outlet formed in the downstream end portion of the mixing path may be less than a diameter of the outlet of the combustion-supporting gas supply swirler. In this configuration, the flow rate of the mixture of the fuel gas and the combustion-supporting gas increases at the mixture injection outlet. Thus, flame is unlikely to be formed at this portion, and the lifted flame is more likely to be formed. Furthermore, a distance over which the fuel gas and the combustion-supporting gas are mixed can be increased.

The burner device according to one embodiment of the present invention may include a plurality of burner body units BU each including the mixing path, the fuel gas injection nozzle, and the combustion-supporting gas supply swirler. A combustion-supporting gas introduction opening through which the combustion-supporting gas is introduced into the burner device may be disposed on an upstream side of the inlet of the combustion-supporting gas supply swirler of each burner body unit BU in a direction in which the fuel gas is injected. In this configuration, the combustion-supporting gas from the combustion-supporting gas introduction opening does not flow directly into the swirler inlet portion opposing each combustion-supporting gas introduction opening unlike in a case where the combustion-supporting gas introduction opening and the swirler inlet are disposed at the axially same position, and is dispersed while the combustion-supporting gas moves backward, thereby uniformly supplying the combustion-supporting gas to the combustion-supporting gas supply swirlers.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF EMBODIMENTS

Figure 1:
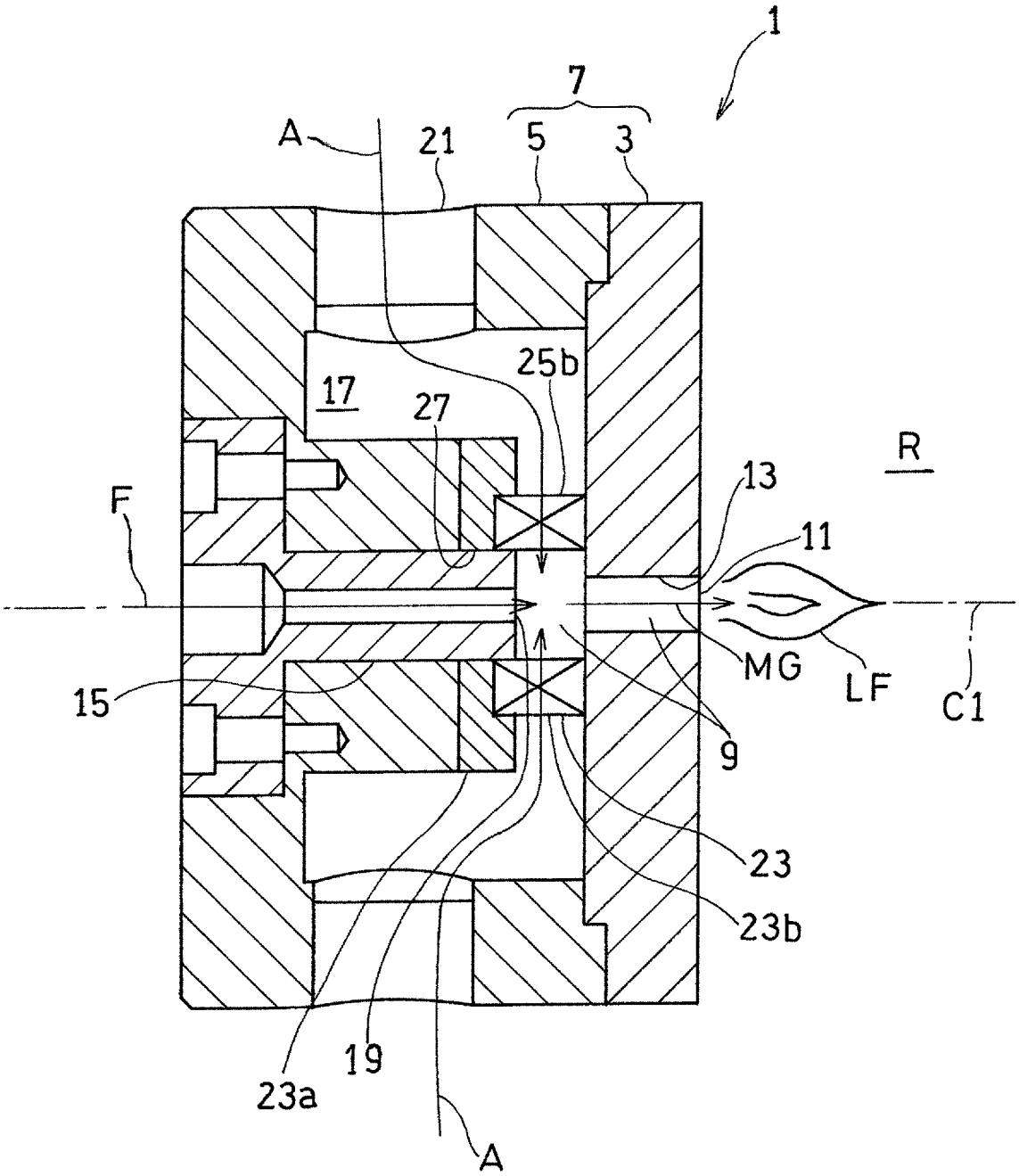
FIG. 1 is a longitudinal cross-sectional view of a burner device according to a first embodiment of the present invention.

A preferred embodiment of the present invention will be described below with reference to the drawings. FIG. 1 shows a burner device 1 according to one embodiment of the present invention. The burner device 1 shown in FIG. 1 supplies a mixture MG of a fuel gas and a combustion-supporting gas to a combustion region R. The burner device 1 is used as, for example, a heating device for a power unit such as a gas turbine and a boiler.

The fuel gas may be, for example, a fuel that has a high combustion speed and a wide range of combustible concentrations. In the present embodiment, a hydrogen-containing gas such as a hydrogen gas is used as the fuel gas. In the present embodiment, an air A is used as the combustion-supporting gas. Other than air, for example, a gas in which the oxygen concentration in the air is adjusted or an exhaust gas may be used as the combustion-supporting gas. In the following description, the fuel gas is represented as "fuel F" and the combustion-supporting gas is represented as "air A".

The burner device 1 is formed into a substantially cylindrical shape as a whole. In the illustrated example, a casing 7 of the burner device 1 is formed by a substantially disk-shaped burner wall 3 that faces the combustion region R and a burner cylinder 5 having a bottomed cylindrical shape. The burner wall 3 is connected to an opening portion of the burner cylinder 5 by, for example, a not-illustrated bolt. The burner device 1 has a mixing path 9 in which the fuel F and the air A are mixed. The mixture MG is injected into the combustion region R from a mixture injection outlet 11 formed in the downstream end portion of the mixing path 9. The mixing path 9 and the mixture injection outlet 11 are disposed so as to be concentric with the burner device 1. In the illustrated example, a mixture injection hole 13 as a through hole in the axial direction is formed at the center portion of the burner wall 3 of the casing 7. The mixture injection outlet 11 is formed as a downstream end opening of the mixture injection hole 13. In the following description, the combustion region R side (that is, the downstream side in the flow of the mixture MG), in the axis C1 direction, of the burner device 1 may be simply referred to as "backward", and the opposite side (that is, the upstream side in the flow of the mixture MG) may be simply referred to as "forward".

The burner device 1 further includes a fuel injection nozzle (fuel gas injection nozzle) 15 for injecting the fuel F into the mixing path 9, and an air supply path (combustion-supporting gas supply path) 17 for supplying the air A to the mixing path 9. The fuel injection nozzle 15 has a fuel injection hole 19 through which the fuel F is injected. The fuel injection hole 19 extends along the axis C1 of the burner device 1. That is, the fuel injection nozzle 15 is configured to inject the fuel F into the mixing path 9 along the axis C1 toward the combustion region R.

Figure 2:
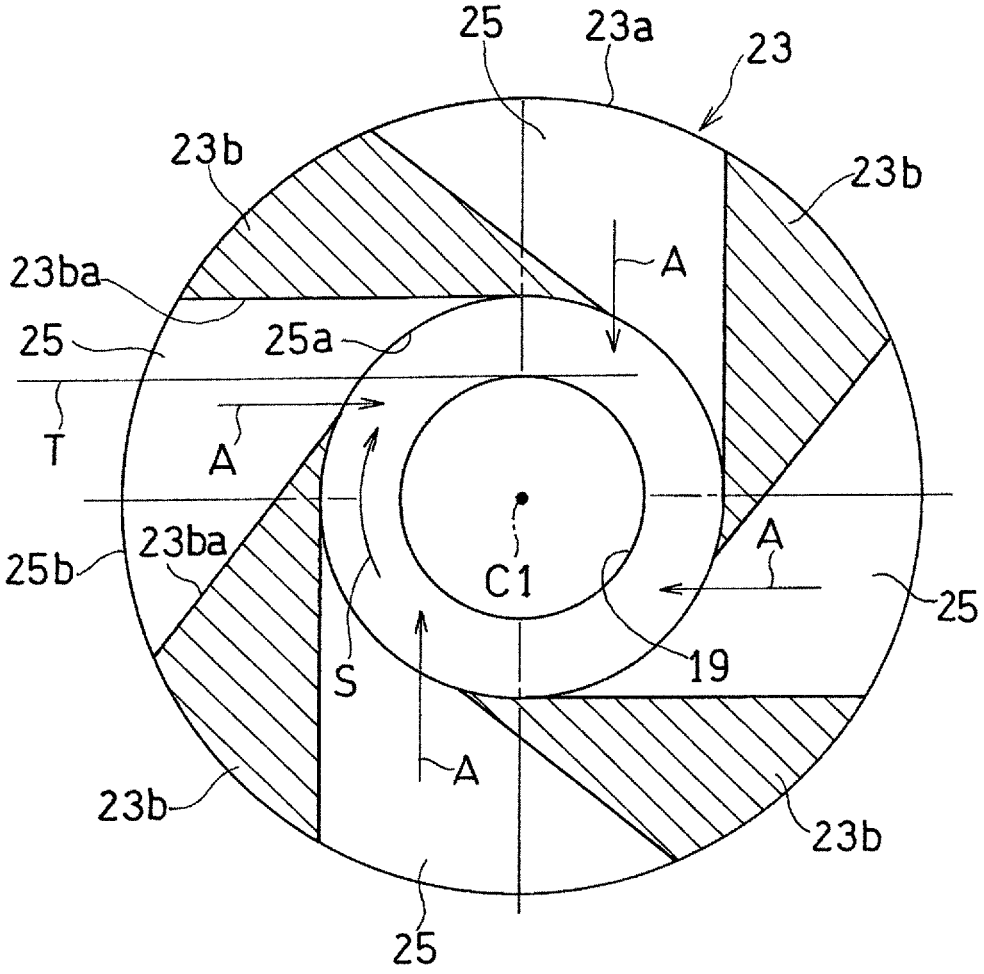
FIG. 2 is a plan view of a combustion-supporting gas supply swirler used for the burner device in FIG. 1.

More specifically, the air supply path 17 allows the air A to be supplied to the mixing path 9 from the radially outer side of the upstream portion of the mixing path 9. In the illustrated example, the air supply path 17 is formed as an internal space of the burner cylinder 5 of the casing 7. A plurality of air introduction openings 21 are formed in the circumferential wall of the burner cylinder 5 of the casing 7. The air A is introduced from the outside through the air introduction openings 21 into the air supply path 17. An air supply swirler (combustion-supporting gas supply swirler) 23 is disposed at the outlet of the air supply path 17. The air A is supplied, as swirling flow around the axis C1, through the air supply swirler 23 into the mixing path 9. As shown in FIG. 2, the air supply swirler 23 includes a plurality (four in this example) of flow paths (hereinafter, referred to as "swirler flow paths") 25 that extend so as to be eccentric relative to the axis C1 and are arranged at regular intervals in the circumferential direction.

In this example, as shown in FIG. 1, the air supply swirler 23 has a base portion 23*a* having an annular plate shape, and a plurality of flow path walls 23*b* that are protrudingly provided on the base portion 23*a*. The base portion 23*a* having an annular plate shape has a center portion formed with a fitting hole 27, into which the outer circumferential surface of the downstream end portion of the fuel injection nozzle 15 is fitted. As shown in FIG. 2, each swirler flow path 25 is formed between the flow path walls 23*b* and 23*b* adjacent to each other. In the illustrated example, wall surfaces 23*ba* and 23*ba* of the two flow path walls 23*b* and 23*b* that extend in respective eccentric directions and form each swirler flow path 25 are each formed into a planar shape (that is, a linear shape in a cross-sectional view orthogonal to the axis C1 of the burner device 1).

More specifically, in the present embodiment, the air supply swirler 23 is configured to inject the air A in the direction of the tangent line T that is tangent to the fuel injection hole 19 in a cross-sectional view orthogonal to the axis C1 of the burner device 1. In the description herein, "is configured to inject the air in the direction of the tangent line that is tangent to the fuel injection hole in a cross-sectional view orthogonal to the axis of the burner device" means that the air supply swirler 23 is positioned and shaped such that the tangent line T that is tangent to the fuel injection hole 19 and parallel to the wall surface 23*b* on the forward side in the swirling direction S of the air A, among the wall surfaces 23*ba* and 23*ba* of the two flow path walls 23*b* and 23*b* that extend in respective eccentric directions and that form each swirler flow path 25, passes through an outlet (hereinafter, referred to as "swirler outlet") 25*a* of the swirler flow path 25 in the cross-sectional view.

The wall surfaces 23*ba* and 23*ba* of the two flow path walls 23*b* and 23*b* that form each swirler flow path 25 and extend in respective eccentric directions may not necessarily have a planar shape as shown therein, and may have, for example, a curved shape. When the wall surface 23*ba* on the forward side in the swirling direction S is formed as a curved surface, the tangent line T that is tangent to the fuel injection hole 19 and parallel to any one point in the downstream-side half portion of the wall surface 23*ba* is determined as the "tangent line that is tangent to the fuel injection hole and parallel to the wall surface".

In the present embodiment, the air supply swirler 23 is configured, due to the above-described structure, such that at least a part of the air A injected from each swirler flow path 25 collides directly with the fuel F injected from the fuel injection hole 19.

In the illustrated example, the width of each swirler flow path 25 of to the air supply swirler 23 is gradually reduced from an inlet (hereinafter, referred to as "swirler inlet") 25*b* of the swirler flow path 25 toward a swirler outlet 25*a*.

Figure 3:
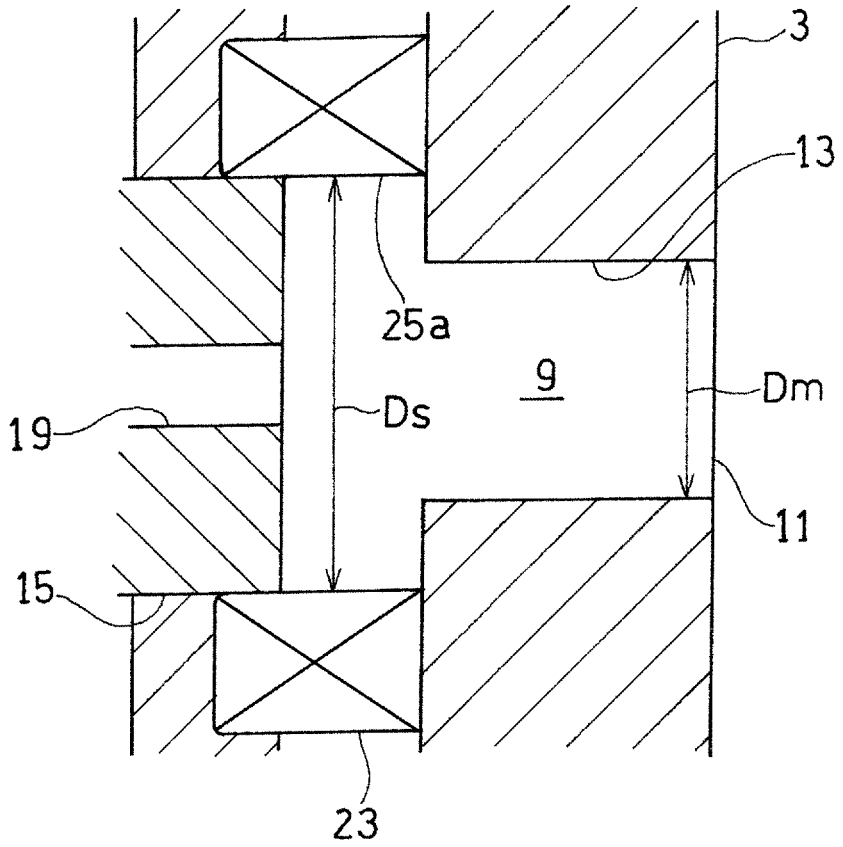
FIG. 3 is a longitudinal cross-sectional view of a part of the burner device in FIG. 1 in an enlarged manner.

As shown in FIG. 3, in the present embodiment, a diameter Dm of the mixture injection outlet 11 formed in the downstream end portion of the mixing path 9 is less than a diameter Ds of the swirler outlet 25*a*. More specifically, in the illustrated example, the burner wall 3 having the mixture injection hole 13 formed therein is in contact with a rear portion of the air supply swirler 23. Therefore, the diameter of the downstream portion (the mixture injection hole 13 in this example) is reduced stepwise from the upstream portion of the mixing path 9, and the diameter Dm of the mixture injection outlet 11 that is the downstream end portion of the downstream portion is also less than the diameter Ds of the swirler outlet 25*a*. The shape from the swirler outlet 25*a* to the mixture injection outlet 11 is not limited to the illustrated shape, and may be, for example, such a shape that the flow path diameter of the downstream portion of the mixing path 9 is reduced so as to be tapered toward the mixture injection outlet 11.

In the burner device 1, shown in FIG. 1, according to the present embodiment described above, the air A (combustion-supporting gas) from the air supply swirler 23 is applied directly to the fuel F (fuel gas) injected from the fuel injection nozzle 15, whereby a space (usually a portion that forms the base portion of a flame), from a portion at which the fuel F is injected, to the combustion region R becomes unstable, and a lifted flame LF is likely to be formed in the combustion region R, and mixture is promoted near the fuel injection hole 19. In addition, swirling flow formed by the air supply swirler 23 forms a recirculation region around the burner axis C1 near the outlet of the mixing path 9 to stably maintain the lifted flame LF.

In the present embodiment, particularly, as shown in FIG. 2, since the width of each swirler flow path 25 of the air supply swirler 23 is gradually reduced from the inlet 25*b* of the air supply swirler 23 toward the outlet 25*a*, air to (combustion-supporting gas) flow is injected at a high speed from the air supply swirler 23, so that a space from the portion at which the fuel F is injected, to the combustion region R, is more effectively made unstable, thereby more stably maintaining the lifted flame LF. Each swirler flow path 25 of the air supply swirler 23 may have a constant width from the swirler inlet 25*b* to the swirler outlet 25*a* unlike in the illustrated example.

In the present embodiment, particularly, as shown in FIG. 3, the diameter Dm of the mixture injection outlet 11 formed in the downstream end portion of the mixing path 9 is less than the diameter Ds of the swirler outlet 25*a*, whereby the flow rate of the mixture MG of the fuel F (fuel gas) and the air A (combustion-supporting gas) increases at the mixture injection outlet 11. Thus, flame is unlikely to be formed near the mixture injection outlet 11, and the lifted flame LF is more likely to be formed. A distance over which the fuel F and the air A are mixed is increased to promote the mixture. Therefore, a high-temperature region is inhibited from being locally formed, and an amount of NOx generated is reduced. The diameter Dm of the mixture injection outlet 11 and the diameter Ds of the swirler outlet 25*a* may be equal to each other.

Next, a burner device 1, shown in FIG. 4, according to a second embodiment of the present invention will be described. The burner device 1 of the present embodiment is different from the burner device of the first embodiment in that the burner device 1 includes a plurality (seven in this example) of burner body units BU, each including the mixing path 9, the fuel injection nozzle 15 and the air supply swirler 23, in one cylindrical casing 7. The structures of the mixing path 9, the fuel injection nozzle 15 (fuel gas injection nozzle), and the air supply swirler 23 (combustion-supporting gas supply swirler) of each burner body unit BU are the same as those in the first embodiment, and the detailed description thereof is omitted.

In the illustrated example, the plurality of burner body units BU are disposed in the casing 7 such that an axis C2 of the cylindrical casing 7 and an axis (axis of the fuel injection nozzle 15) C3 of each burner body unit BU are parallel with each other.

More specifically, the internal space of the casing 7 is sectioned by a disk-shaped separation wall 31 into an air introduction chamber 33 on the downstream side (combustion region R side) and a fuel introduction chamber 35 on the upstream side. The plurality of burner body units BU are disposed in the air introduction chamber 33. The fuel F is introduced from the outside into the fuel introduction chamber 35 through a fuel introduction hole 37 formed at the center portion of the bottom wall of the casing 7. The separation wall 31 has a fuel supply hole 39 at a position corresponding to the fuel injection hole 19 of each fuel injection nozzle 15. The fuel F introduced into the fuel introduction chamber 35 is supplied into the fuel injection hole 19 through each fuel supply hole 39. Thus, the fuel F is introduced from the outside into the shared fuel introduction chamber 35 and then supplied into the plurality of fuel injection holes 19, whereby the fuel F is uniformly supplied into the fuel injection holes 19.

Figure 5:
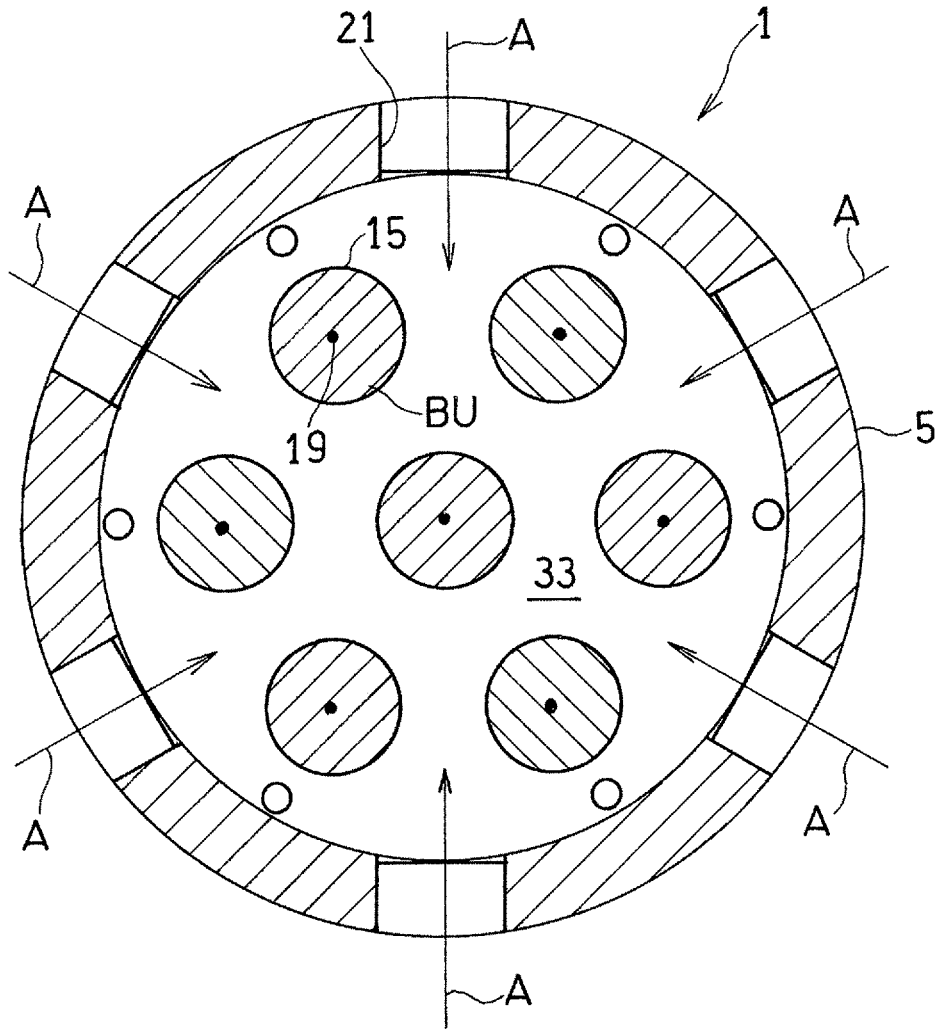
FIG. 5 is a cross-sectional view taken along a line V-V in FIG. 4.

The air A is introduced from the outside into the air introduction chamber 33 through the air introduction openings 21 formed in the downstream side portion of the circumferential wall of the casing 7. As shown in FIG. 5, a plurality (six in this example) of the air introduction openings 21 are disposed at regular intervals in the circumferential direction. In the illustrated example, one of the burner body units BU is disposed at the center portion of the air introduction chamber 33, and a plurality (six in this example) of the burner body units BU are arranged around the one of the burner body units BU at regular intervals in the circumferential direction. Each of the air introduction openings 21 is formed at the circumferential position corresponding to the center between the burner body units BU adjacent to each other among the burner body units BU arranged in the circumferential direction. The number of the air introduction openings 21 and the arrangement thereof in the circumferential direction are not limited to this example.

Figure 4:
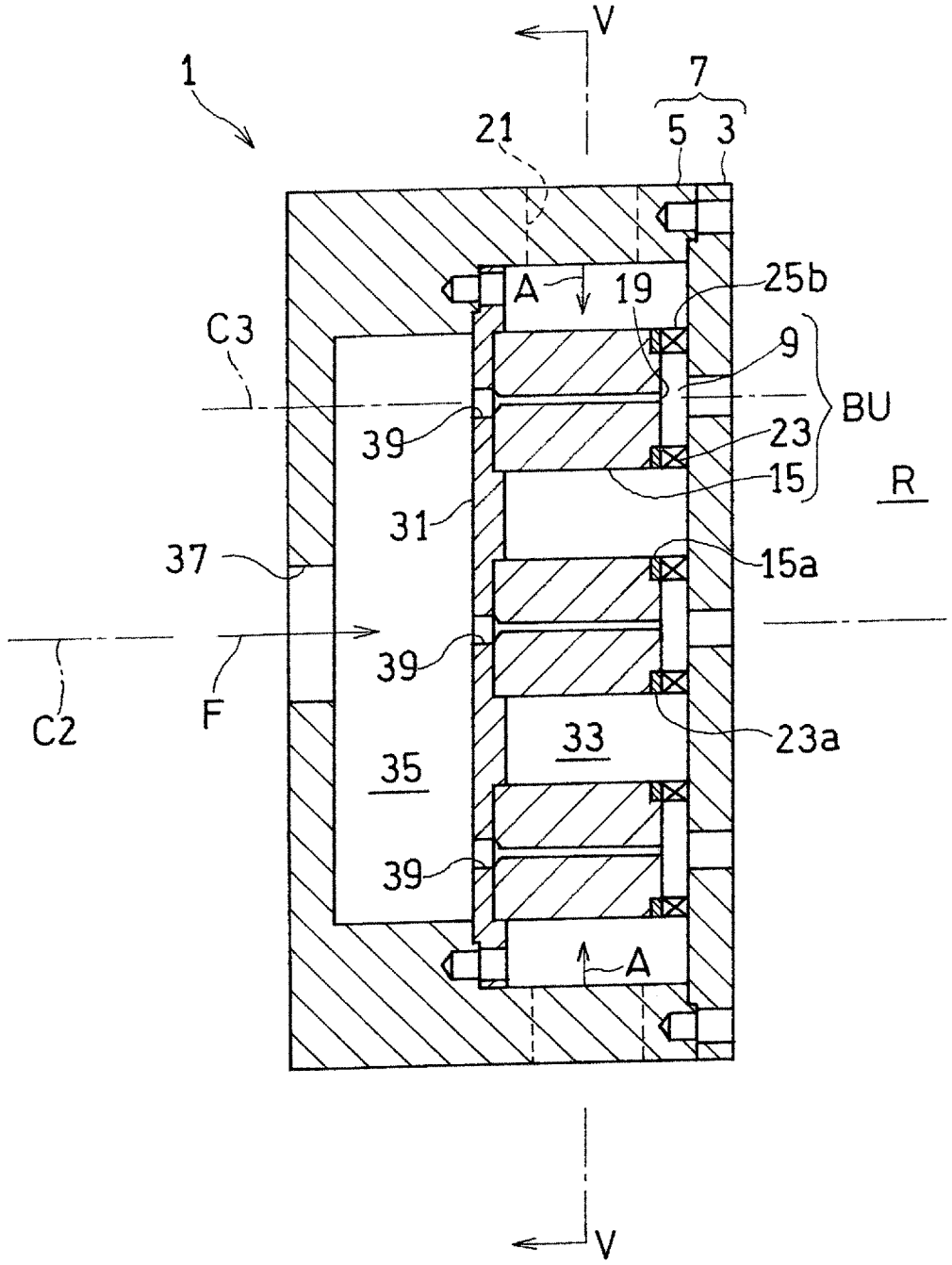
FIG. 4 is a longitudinal cross-sectional view of a burner device according to a second embodiment of the present invention.

As shown in FIG. 4, each of the air introduction openings 21 is disposed on the side upstream of the swirler inlet 25*b* of each burner body unit BU in the direction (the axial direction of the burner device 1 in the illustrated example) in which the fuel F is injected. When the air introduction openings 21 are thus arranged, the air A from the air introduction opening 21 does not flow directly into the swirler inlet 25*b* portion opposing each air introduction opening 21 unlike in a case where the air introduction opening 21 and the swirler inlet 25*b* are disposed at the axially same position, and is dispersed while the air A moves backward, thereby uniformly supplying the air A to the air supply swirlers 23.

More specifically, in the illustrated example, the annular-plate-shaped base portion 23*a* of the air supply swirler 23 fits into a fitting portion 15*a* formed in the outer circumferential surface of the downstream end portion of the fuel injection nozzle 15, and each of the air introduction openings 21 is formed at a position, in the axis C2 direction, corresponding to a portion forward of the fitting portion 15*a* of the fuel injection nozzle 15. When the air introduction openings 21 are thus arranged, the air A introduced from the air introduction opening 21 collides with the fuel injection nozzle 15, and then flows backward and is introduced into the swirler inlet 21. Therefore, during the process, the dispersion of the air A from the air introduction opening 21 progresses, and the air A is very uniformly supplied into the air supply swirlers 23.

Also in the first embodiment shown in FIG. 1, each of the air introduction openings 21 is disposed on the side upstream of the swirler inlet 25*b* in the direction in which the fuel F is injected, and the air A is thus supplied to the plurality of the swirler inlets 25*b* uniformly. As in the second embodiment, when a plurality of the burner body units BU (a plurality of air supply swirlers 23) are disposed in the shared air introduction chamber 33, the flow of the air A is likely to be uneven. Therefore, when the air introduction opening 21 is disposed on an upstream side of the swirler inlet 25*b*, the above-described effect can be enhanced.

Although the present invention has been fully described in connection with the preferred embodiments thereof with reference to the accompanying drawings, various additions, modifications, or deletions may be made without departing from the gist of the invention. Accordingly, such additions, modifications, and deletions are to be construed as included within the scope of the present invention.

REFERENCE NUMERALS

1 . . . Burner device
9 . . . Mixing path
15 . . . Fuel injection nozzle (Fuel gas injection nozzle)
21 . . . Air introduction opening (Combustion-supporting gas introduction opening)
23 . . . Air supply swirler (Combustion-supporting gas supply swirler)
25 . . . Swirler flow path
25*a* . . . Swirler outlet
25*b* . . . Swirler inlet
A . . . Air (Combustion-supporting gas)
BU . . . Burner body unit
F . . . Fuel (Fuel gas)
MG . . . Mixture
R . . . Combustion region

What is claimed is:

1. A burner device for supplying a mixture of a fuel gas and a combustion-supporting gas into a combustion region, the burner device comprising:

a mixing path configured to inject the mixture from a downstream end portion of the mixing path into the combustion region;

a fuel gas injection nozzle configured to inject the fuel gas into the mixing path toward the combustion region; and a combustion-supporting gas supply swirler configured to inject the combustion-supporting gas from a radially outer side into the mixing path such that at least a part of the combustion-supporting gas collides directly with the fuel gas injected from the fuel gas injection nozzle, in a direction of a tangent line that is tangent to a fuel injection hole of the fuel gas injection nozzle in a cross-sectional view orthogonal to an axis of the burner device; and a plurality of burner body units each including the mixing path, the fuel gas injection nozzle, and the combustion-supporting gas supply swirler, wherein a combustion-supporting gas introduction opening through which the combustion-supporting gas is introduced into the burner device is disposed on an upstream side of the inlet of the combustion-supporting gas supply swirler of each burner body unit in a direction in which the fuel gas is injected, wherein a width of a flow path of the combustion-supporting gas supply swirler is gradually reduced from an inlet of the combustion-supporting gas supply swirler toward an outlet thereof, wherein the inlet faces away from the mixing path, and wherein the outlet faces towards the mixing path.

2. The burner device as claimed in claim 1, wherein a diameter of a mixture injection outlet formed in the downstream end portion of the mixing path is less than a diameter of the outlet of the combustion-supporting gas supply swirler.

3. The burner device as claimed in claim 1, wherein the combustion-supporting gas supply swirler comprises a plurality of outlets, including the outlet, along the radially outer side into the mixing path, and wherein the plurality of outlets are opposite to each other across the radially outer side.

4. The burner device as claimed in claim 1, wherein the swirler further comprises a flow path extended from the inlet to the outlet and comprising a plurality of wall surfaces.

* * * * *